United States Patent [19]

Suburu

[11] Patent Number: 4,911,297

[45] Date of Patent: Mar. 27, 1990

[54] WRENCH HOLDER

[76] Inventor: Ronald Suburu, 11341 Ashe Rd., Bakersfield, Calif. 93313

[21] Appl. No.: 394,140

[22] Filed: Aug. 14, 1989

[51] Int. Cl.[4] ..... B25H 3/04

[52] U.S. Cl. ..... 206/376; 206/372; 211/70.6

[58] Field of Search ..... 206/376, 377, 378, 379, 206/372, 481, 483; 211/70.6

[56] References Cited

U.S. PATENT DOCUMENTS

| | | | |
|---|---|---|---|
| 1,967,458 | 7/1934 | Vallone | 206/376 |
| 2,119,217 | 5/1938 | Rocci | 206/376 |
| 3,370,696 | 6/1966 | Negroe | 206/376 X |
| 3,702,136 | 11/1972 | Albertson | 206/376 |
| 3,837,477 | 9/1974 | Boudreau | 206/376 |
| 4,705,168 | 11/1987 | Ward | 206/376 |

FOREIGN PATENT DOCUMENTS

| | | | |
|---|---|---|---|
| 598385 | 5/1960 | Canada | 211/70.6 |
| 2160763 | 1/1986 | United Kingdom | 211/70.6 |

*Primary Examiner*—Stephen Marcus
*Assistant Examiner*—Jacob Ackun, Jr.
*Attorney, Agent, or Firm*—Christie, Parker & Hale

[57] ABSTRACT

A wrench holder employing a retaining bar and upstanding slotted holding member which in combination restrain the open-end heads of a wrench set. The restraining bar is mounted in angular spaced relation to the holding member whereby a wrench held in the invention must be rotated through a substantial portion of a 90° arc before the handle is no longer engaged in a slot in the holding member and the shank and jaws are no longer constrained between the upstanding member and the restraining bar.

11 Claims, 2 Drawing Sheets

WRENCH HOLDER

BACKGROUND OF THE INVENTION

This invention relates generally to the field of devices which store tools. In particular, this invention provides an apparatus that serves as a holder and carrying case for a set of open end wrenches of increasing size.

Commonly such wrenches are haphazardly strewn throughout a worker's toolbox. Various apparatus have been used to organize and store these wrenches. These devices include both self-contained units as well as systems to arrange drawers for storage. The portable methods are usually comprised of slots to set the wrenches in and a constraining device to close the slots. The necessity for the constraining device to secure the wrenches in place made easy access to the wrenches difficult since the slots need to be continually open and shut to get to the wrenches, and without the constraining device the wrenches would readily move out of the slots if the holding device was moved around.

The drawer organizing systems, on the other hand, provide easy accessibility since they lack any constraining device. However, these systems lack the necessary portability.

A simple apparatus that provides both portability and accessibility, while keeping wrenches in an organized fashion is desirable. In addition, a device which will accommodate both double end wrenches and hex head wrenches would be even more useful.

SUMMARY OF THE INVENTION

The present invention provides a holder and carrying case for a set of wrenches of increasing size which have at least one open end head extending from the handles.

The holder comprises a base tray with an upstanding holding member having multiple slots and a restraining bar mounted at a first angle to the base tray and at a second angle to the holding member. In the specific arrangement of the invention, the wrench handles fit into the slots and the open jaws of the wrenches fit around the restraining bar. The height of the holding member and the slots therein is determined in relation to the spacing of the restraining bar from the upstanding member such that a wrench held in the invention must be rotated through a substantial portion of a 90 degree arc before the handle is no longer engaged in the slot, the shank is no longer constrained between the upstanding member and the restraining bar, and the open end of the jaws of the wrench is pointed substantially to the base tray to allow disengagement of the jaw from the restraining bar.

A second embodiment of the invention adds as an additional feature a removable bar or strap connected to the base for constraining the handles of the wrenches held in the device, thus preventing the wrenches from rotating.

Another embodiment of the invention consists of a larger base tray with two pairs of upstanding holding members and restraining bars, each pair on opposite ends of the tray so that two sets of wrenches can be stored on one device. This embodiment may also employ a removable bar or strap as described above to prevent both sets of wrenches from rotating.

DETAILED DESCRIPTION OF THE INVENTION

Figure 1:
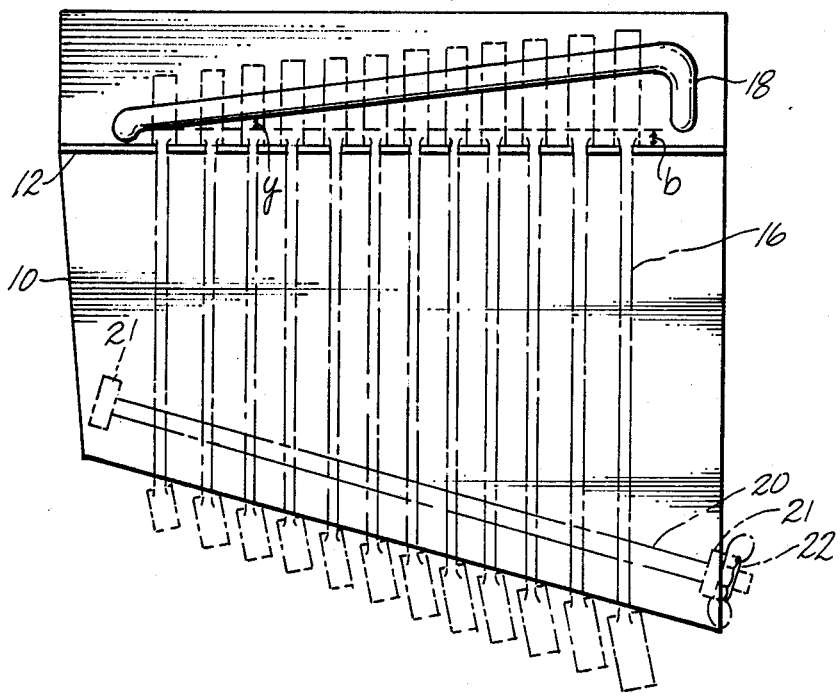
FIG. 1 provides a top view of the wrench holder showing its basic components and also a removable bar.
Figure 2:
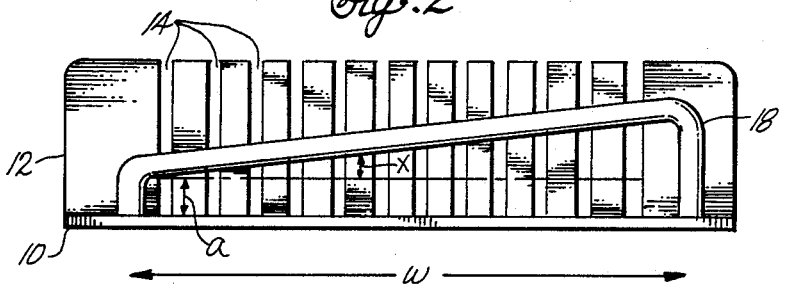
FIG. 2 is an end view looking into the slots which will house the open jaws of the wrenches constrained by the holder.

As shown in FIGS. 1 and 2 the preferred embodiment of the invention comprises a flat base tray 10, quadrilateral in shape with at least two parallel edges, having an upstanding holding member 12 set perpendicular to the base and situated parallel to and near a first edge of the tray. This holding member 12 contains a series of parallel slots 14 of sufficient width such that the handles **16*a* of a wrench 16 may slide in and out, but narrow enough such that the shank 16*b* and open jaws 16*c*** of the wrench will not slide through.

Figures 3, 4:
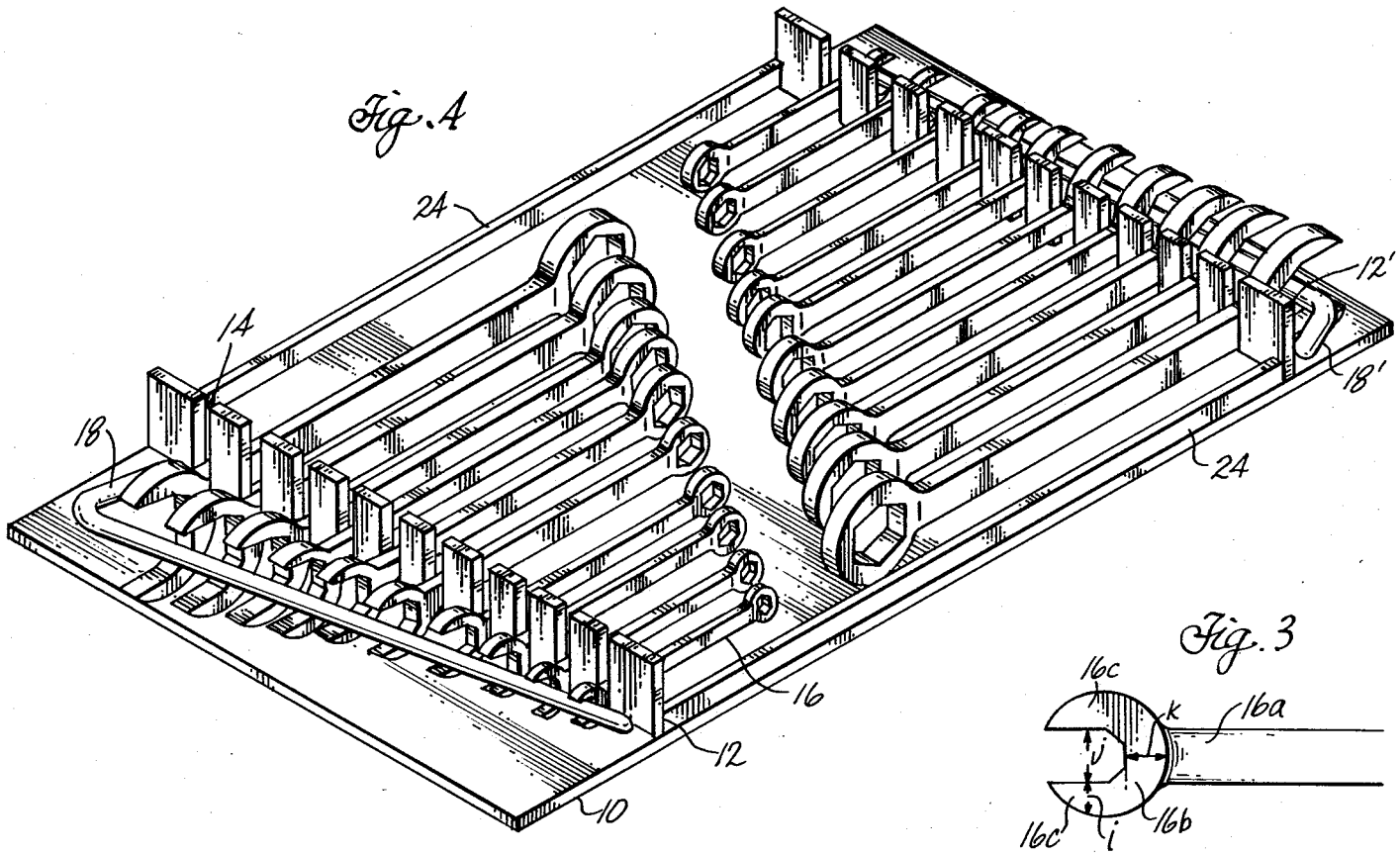
FIG. 3 contains a detailed drawing of a typical wrench head.
FIG. 4 shows a pictorial perspective of a wrench holder which contains two sets of wrenches on one tray.

Also attached to the tray, situated between the top edge and the holding member, is a restraining bar 18. The restraining bar 18 is mounted in spaced relation at a first angle x to the base tray 10 and at a second angle y to the holding member 12. The first angle x is determined to accommodate the increasing width of the jaw of the wrenches. The bar should be raised at one end of the tray height, a, above the base tray. The height, a, will be determined to accommodate the width of the open jaw of the smallest wrench to be stored in the holder and so must be at least as high as the distance, i, from the inner to outer jaw (as seen in FIG. 3). The elevation of the remainder of the restraining bar 18 will rise at an angle x such that the height of the bar at the other side of the tray shall be $a+w(\tan x)$ where w is the width of the base tray upon which the restraining bar is mounted. This angle x shall be calculated such that the height of the bar at this one end $(a+w(\tan x))$ shall accommodate the width of the open jaw of the largest wrench to be stored in the holder, thus no higher than $i+j$.

Similarly, the second angle y is determined to accommodate the increasing length of the head of the wrenches. The bar 18 shall be spaced an initial distance, b, from the holding member to accommodate the length of the smallest wrench head at one end of the tray 10. The dimension b shall be at least as long as the distance k from the inner to outer jaw, as seen in FIG. 3. Then the distance of the bar from the holding member will increase by an angle y such that the distance between the bar and the holding member at the other side of the tray shall be $b+w(\tan y)$, and this distance shall accommodate the head length of the largest wrench to be stored in the holder.

The embodiment of the invention shown in the drawings reflects a restraining bar fabricated from a single piece of rod material. A first end of the rod is welded to the base tray between the first edge of the tray and the upstanding member. The bar extends upwardly substantially perpendicular to the base tray to the height a above the base tray. The bar is then bent to extend upwardly and angularly at the angle x with respect to the base tray and angularly outwardly towards the first edge with respect to the upstanding holding member. At a second height a+w(tanyx), the restraining bar again is bent, turning downwardly and extending substantially perpendicularly to be welded again to the base tray. Those skilled in the art will recognize alternative attachment methods for the restraining bar including attachments to the upstanding member or mixed attachment to the base and upstanding member.

The diameter of the restraining bar 18 shall be determined to accommodate the jaw width of the smallest wrench to be stored. In the embodiment of the invention shown in the drawings, this diameter is constant throughout the length of the bar. A bar of increasing diameter to match increasing jaw width may be employed.

The height of the holding member and the slots therein is determined in relation to the spacing of the restraining bar from the upstanding member such that a wrench held by the invention must be rotated through a substantial portion of a 90 degree arc before, as a combination, the handle is no longer engaged in the slot, the shank is no longer constrained between the upstanding member and the restraining bar, and the open end of the jaws of the wrench is pointed substantially to the base tray to allow disengagement of the jaw from the restraining bar.

As an additional feature, a removable bar or strap may be connected to the base for constraining the handles of the wrenches held in the device. As shown in FIG. 1, a removable bar 20 may be received through the stanchions 21 and secured into place by a wing nut 22. The stanchions are positioned on each side of the end of the base tray opposite from the holding member and restraining bar. This bar or strap would help prevent the handles of the wrenches held in the device from rotating if the invention was inadvertently turned upside down.

As an alternate embodiment of the invention, the base tray may be elongated and a second holding member 12' and restraining bar 18' attached in a similar fashion at the opposite end of the tray to accommodate a second set of wrenches as shown in the perspective view of FIG. 4. Another feature of the embodiment shown in FIG. 4 is the addition of sides 24 mounted to the base tray 10 on the edges parallel to the wrenches. These elevated sides 24 serve to prevent the wrenches from rotating sideways off the tray while being transported when no removable strap or bar is attached.

A second alternative embodiment is obtained by mounting the second holding member and second restraining bar parallel to and adjacent the first holding member and restraining bar. Multiple sets of wrenches may thereby be separately carried in the wrench holder.

Preferred materials of construction for the wrench holder include metal, heavy plastic, or other rigid material. The present embodiment of the invention is constructed of welded sheet steel.

Having now described the features of the present invention in detail as required by the patent statutes those skilled in the art will recognize alterations and modifications to the invention to meet special needs. Those modifications and alterations are included within the scope of the invention as defined in the following claims.

What is claimed is:

1. An apparatus for holding and carrying a set of wrenches arranged in parallel, each wrench having an elongated handle and at least one open end head with a shank and jaws, the apparatus comprising:

a base tray;

a first upstanding holding member mounted substantially perpendicular to the base tray having multiple slots sized to receive the handles of the wrenches; and a first restraining bar mounted to the base tray at a first angle in spaced relation to the tray and at a second angle in spaced relation to the holding member, the bar engaging the open end head of each wrench of the set.

2. The device as defined in claim 1 wherein the base tray is flat.

3. The device as defined in claim 1 further comprising upstanding elongated sides mounted to the base tray parallel to the wrench handles.

4. The device as defined in claim 1 further comprising a means for removably constraining the wrench handles in the apparatus.

5. The device as defined in claim 4 wherein the means for removably constraining the wrench handles is a removable bar and means for attaching the bar to the base plate.

6. The device as defined in claim 4 wherein the means for removably constraining the wrench handles is a removable strap and means for attaching the strap to the base plate.

7. The device as defined in claim 1 further comprising a second holding member and a second restraining bar mounted to the base tray in spaced relation to and in opposite orientation from the first holding member and first restraining bar whereby two sets of wrenches are held between the first holding member and first restraining bar and second holding member and second restraining bar.

8. The device as defined in claim 1 further comprising a second holding member and a second restraining bar mounted to the base tray next to the first holding member and first restraining bar whereby two sets of wrenches are held side-by-side by the first holding member and first restraining bar and second holding member and second restraining bar.

9. The device as defined in claim 1 wherein the restraining bar is substantially parallel to one edge of the base tray.

10. The device as defined in claim 1 wherein the upstanding holding member is substantially parallel to one edge of the base tray.

11. An apparatus for holding and carrying wrenches of increasing size arranged in parallel, each wrench having an elongated handle and at least one open end head with a shank and jaws, the apparatus comprising:

a substantially flat base tray;

a first upstanding holding member mounted substantially perpendicularly to the base tray and substantially parallel to a first edge of the base tray, the holding member having a plurality of slots sized to receive the handles of the wrenches therein;

a first restraining bar adapted for engagement by the open end head of each wrench, the bar extending from a first end, upwardly and substantially perpendicularly from the base tray to a first point proximate the upstanding holding member and spaced therefrom, the bar further extending upwardly angularly at a first angle in spaced relation to the tray and angularly outwardly toward the first edge at a second angle in spaced relation to the holding member to a second point distal the holding member and further extending substantially downwardly perpendicular to the base tray and attaching to the base tray at a second end, the first angle of the bar determined to accommodate increasing jaw size of the wrench set and the second angle determined to accommodate the increasing shank size of the wrench set;

a first stanchion extending substantially perpendicularly from the base tray opposite the first end of the restraining bar with respect to the upstanding member;

a second stanchion extending substantially perpendicularly from the base plate opposite the second end of the restraining bar with respect to the upstanding member whereby the handles of the wrench set extend between the first and second stanchions; and a restraining member extending between the first stanchion and second stanchion and removably attached thereto.

* * * * *